United States Patent [19]

Morioka et al.

[11] Patent Number: 4,658,480

[45] Date of Patent: Apr. 21, 1987

[54] FLUID-TIGHT SLIDE FASTENER

[75] Inventors: Koitsu Morioka; Masahiro Kusayama, both of Kurobe, Japan

[73] Assignee: Yoshida Kogyo K.K., Tokyo, Japan

[21] Appl. No.: 890,176

[22] Filed: Jul. 25, 1986

[30] Foreign Application Priority Data

Jul. 27, 1985 [JP] Japan ..... 60-116106[U]

[51] Int. Cl.[4] ..... A41D 13/00

[52] U.S. Cl. ..... 24/389; 24/384

[58] Field of Search ..... 24/384, 389

[56] References Cited

U.S. PATENT DOCUMENTS

| | | | |
|---|---|---|---|
| 3,005,247 | 10/1961 | Doellter | 24/389 |
| 3,167,834 | 2/1965 | Schmiele | 24/389 |
| 3,905,073 | 9/1975 | Fukuroi . | |
| 4,275,467 | 6/1981 | Doelter | 24/389 |
| 4,488,338 | 12/1984 | Takahashi . | |
| 4,505,008 | 3/1985 | Yoshikawa | 24/389 X |
| 4,513,482 | 4/1985 | Fukuroi . | |
| 4,524,493 | 6/1985 | Inamura | 24/389 |
| 4,604,775 | 8/1986 | Kusayama | 24/389 |

FOREIGN PATENT DOCUMENTS

| | | | |
|---|---|---|---|
| 1448529 | 6/1966 | France | 24/389 |
| 34-10974 | 12/1959 | Japan . | |
| 48-39368 | 11/1973 | Japan . | |
| 53-42161 | 10/1978 | Japan . | |
| 57-22314 | 2/1982 | Japan . | |
| 58-181211 | 12/1983 | Japan . | |
| 59-93208 | 6/1984 | Japan . | |
| 59-51805 | 12/1984 | Japan . | |

*Primary Examiner*—Peter A. Aschenbrenner

*Attorney, Agent, or Firm*—Hill, Van Santen, Steadman & Simpson

[57] ABSTRACT

A fluid-tight slide fastener of the type in which an inner longitudinal edge portion of each of opposed tapes is folded so as to extend around base portions of successive I-shaped coupling elements and in which successive U-shaped first clamping strips surround, in clinched form, the folded edge portion over the base portion of the respective coupling element, each of opposed top stops includes an elongate plate of an I-shaped cross section corresponding to the shape of the coupling elements and having a base part surrounded by the folded edge portion of the tape, and a second clamping strip of a C-shaped cross section corresponding to the shape of the first clamping strips and surrounding, in clinched form, the folded edge portion over the base part of the elongate plate. When the slide fastener is fully closed, the opposed top stops are entirely received in the guide channel of a slider.

5 Claims, 18 Drawing Figures

FLUID-TIGHT SLIDE FASTENER

BACKGROUND OF THE INVENTION

1. Field of the Invention

The present invention relates to fluid-tight (airtight and watertight) slide fasteners, and more particularly to a fluid-tight slide fastener suitable for working clothes for construction workers in rivers, fishermen and farmers.

2. Description of the Prior Art

Known airtight and watertight (hereinafter referred to as "fluid-tight") slide fasteners have a fluid-tightness throughout the entire length thereof including at portions around top stops. As disclosed in Japanese Patent Publication (Kokoku) 34-10974 and as reillustrated here in FIGS. 10A, 10B and 10C, this prior slide fastener has a top stop B of generally C-shaped cross section secured in clinched form to top end portions A of a pair of opposed fastener stringers so as to effect a fluid-tightness therebetween; the upward movement of a slider C is terminated when the slider C comes into abutting engagement with a lower end of the top stop B. In other words, the top stop B does not enter the guide channel of the slider C even when the slide fastener is fully closed.

Because of such exposed top stop B, the prior slide fastener is unpleasant in appearance.

SUMMARY OF THE INVENTION

It is therefore an object of the present invention is to provide a fluid-tight slide fastener having a pair of top stops which can entirely enter a coupling-element guide channel of a slider when the slide fastener is fully closed, thus making the slide fastener neat in appearance.

Another object of the invention is to provide a fluid-tight slide fastener having a pair of top stops which can stop a slider reliably.

According to the present invention, in a fluid-tight slide fastener of the type in which an inner longitudinal edge portion of each of opposed tapes is folded so as to extend around base portions of successive I-shaped coupling elements and in which successive U-shaped first clamping strips surround, in clinched form, the folded edge portion over the base portion of the respective coupling element, each of opposed top stops includes an elongate plate of an I-shaped cross section corresponding to the shape of the coupling elements and having a base part surrounded by the folded edge portion of the tape, and a second clamping strip of a C-shaped cross section corresponding to the shape of the first clamping strips and surrounding, in clinched form, the folded edge portion over the base part of the elongate plate. When the slide fastener is fully closed, the opposed top stops are entirely received in the guide channel of a slider.

Many other advantages, features and additional objects of the present invention will become manifest to those versed in the art upon making reference to the detailed description and the accompanying drawings in which certain preferred embodiments incorporating the principles of the present invention are shown by way of illustrative example.

DETAILED DESCRIPTION

Figure 1:
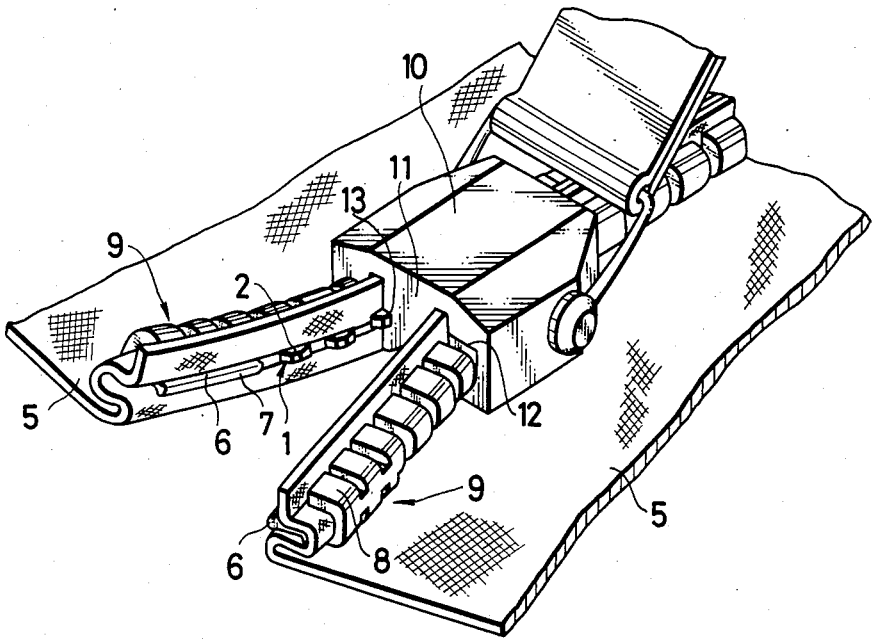
FIG. 1 is a fragmentary perspective view of a fluid-tight slide fastener embodying to present invention.
Figure 2:
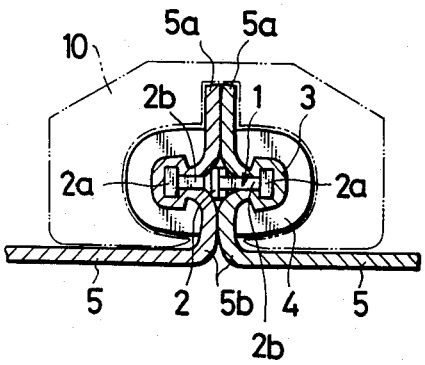
FIG. 2 is a fragmentary transverse cross-sectional view of the FIG. 1, showing the state in which a pair of series of coupling elements is coupled together.
Figure 3:
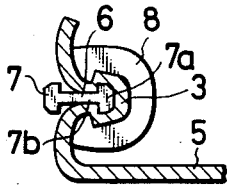
FIG. 3 is a fragmentary transverse cross-sectional view of FIG. 1, showing the manner in which one of opposed top stops is attached to a respective tape.

FIG. 1 shows a fluid-tight slide fastener comprising a pair of opposed fastener stringers, each including a tape 5 made of a fluid-tight soft material such as natural or synthetic rubber, or made of natural or synthetic fibers coated with such a fluid-tight material. As shown in FIGS. 1, 2 and 3, the tape 5 has an inner longitudinal margin folded through its entire length so as to provide a folded edge portion 3 and two contact portions (hereinafter referred to as "first and second contact portions 5*a*, 5*b* disposed on each side of said edge portion 3 and contiguous thereto. The first and second contact portions 5*a*, 5*b* are laterally (vertically in FIGS. 1, 2 and 3) spaced from each other. The first and second contact portions 5*a*, 5*b* of one stringer are adapted to engage corresponding first and second contact portions 5*a*, 5*b* of the other stringer to effect a fluid-tightness i.e. air tightness and watertightness, between the two stringers.

A series of discrete coupling elements 1 is mounted on and along the folded edge portion 3 of each tape 5; each coupling element 1 has a generally I-shaped cross section having a base portion 2*a*, a leg portion 2*b*, and a head portion 2. The folded edge portion 3 of the tape 5 extends around the base portion 2*a* of each coupling element 1. A series of generally C-shaped first clamping strips 4 is also mounted in clinched form on and along the folded edge portion 3 of the tape 5, each first clamping strip 4 surrounding the folded edge portion 3 of the tape 5 over the base portion 2*a* of a respective one of the coupling elements 1. The series of coupling elements 1 of one stringer is engageable with the series of coupling elements of the other stringer by pulling a slider 10 which is mounted on the opposed stringers for movement along such two series of coupling elements 1 to open and close the slide fastener.

The slider 10 defines a guide channel 12 for the passage of the two series of coupling elements 1, 1, and has a central separator 11 (FIGS. 1, 4 and 5) dividing a flaring end of the guide channel 12 into two branches. The central separator 11 has in its opposite side surfaces a pair of grooves 13, 13 each opening to a respective one of the branches of the guide channel 12 for receiving the head portions 2 of the respective series of coupling elements 1. When the slider 10 is pulled upwardly or forwardly along the opposed series of coupling elements 1, 1 to couple the same together, the first and second contact portions 5*a*, 5*b* of one stringer is pressed against the first and second contact portions 5*a*, 5*b* of the other stringer as shown in FIG. 2 to effect a fluid-tightness between the two stringers.

Figure 5:
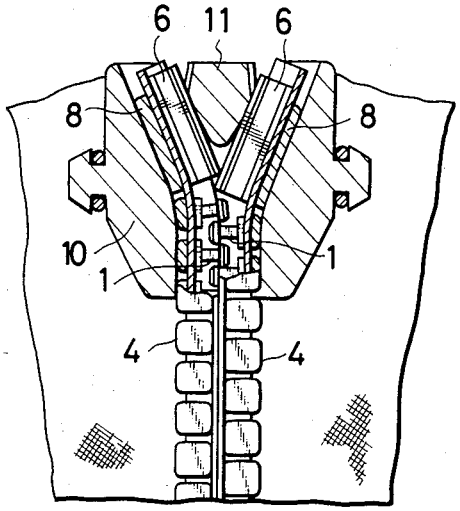
FIG. 5 is a view similar to FIG. 4, showing the top stops having entirely entered a slider to prevent further upward movement of the slider.

The slide fastener also has a pair of top stops 9, 9 each attached to a respective one of the stringers at a position adjacent to a top end of each series of coupling elements 1 for restricting the upward movement of the slider 10 in a manner described below. Most importantly, each top stop 9 includes an elongate plate 6 mounted on the folded edge portion 3 of the tape 5 and having a generally I-shaped cross section substantially corresponding to the shape of the individual coupling element 1. The elongate plate 6 has a base part 7*a*, a leg part 7*b* and a head part 7, which correspond to the base portion 2*a*, the leg portion 2*b* and the head portion 2, respectively, of the individual coupling elements 1. The folded edge portion 3 of the tape 5 extends around the base portion 7*a*. Each top stop 9 also includes a second clamping strip 8 mounted in clinched form on the folded edge portion 3 of the tape 5 and having a generally C-shaped cross section corresponding to the shape of the individual first clamping strip 4. The second clamping strip 8 surrounds the folded edge portion 3 of the tape 5 over the base part 7*a* of the elongate plate 6. The elongate plate 6 has such a length as to be completely received in the guide channel 12 of the slider 10 as shown in FIG. 5 when the slide fastener is fully closed.

Figure 4:
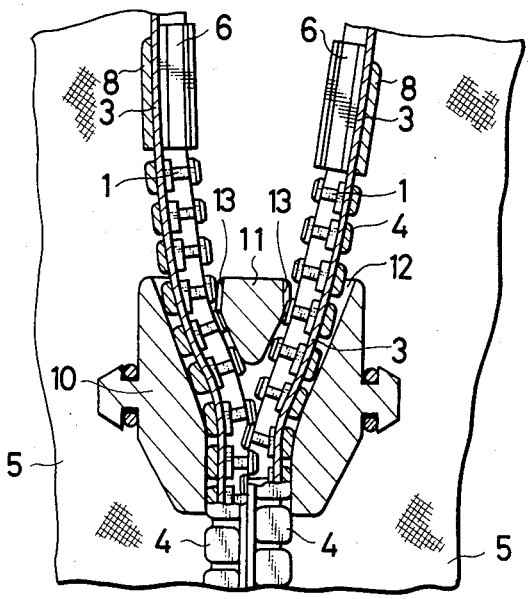
FIG. 4 is a plan view, with parts in cross section, of the structure of FIG. 1, showing top end portions of opposed fastener stringers in uncoupled position.

When the slider 10 is pulled upwardly in FIG. 4, the opposed series of coupling elements 1, 1 are coupling with each other progressively toward the top stops 6, 6 so as to effect an adequate fluid-tightness between the opposed stringers through the entire length of the opposed series of coupling elements 1, 1. With continued upward pulling of the slider 10, the two elongate plates 6, 6, together with the respective second clamping strips 8, 8, enter the two branches of the guide channel 12 of the slider 10 until the two elongate plates 6, 6 block each other at the junction of the two channel branches, thus preventing further upward movement of the slider 5 reliably. The two grooves 13, 13 of the central separator 11 serve to receive the respective head parts 7, 7 of the two elongate plates 6, 6, so that the two elongate plates 6, 6 can enter the guide channel 12 smoothly in proper posture.

Figures 6A, 6B, 6C, 6D:
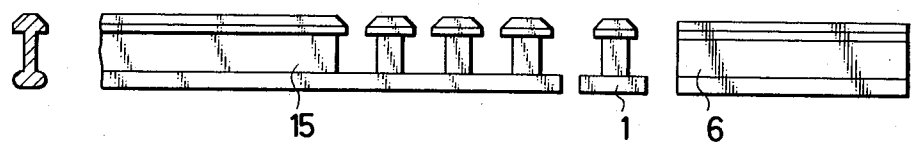
FIG. 6A is a fragmentary plan view of a first blank strip, illustrating the manner in which the coupling elements and the top stops are manufactured from the first blank strip.
FIG. 6B is a transverse cross-sectional view of FIG. 6A.
FIG. 6C is a plan view of the individual coupling element.
FIG. 6D is a plan view of the individual top stop.

The individual coupling elements 1 and the individual elongate plate 6 are manufactured from a continuous length of first blank strip 15 of generally I-shaped cross section (FIG. 6B) by punching and/or cutting the first blank strip 15. Preferably, the length of each elongate strip 5 is several times the width of a single coupling element 1.

Figures 7A, 7B, 7C, 7D:
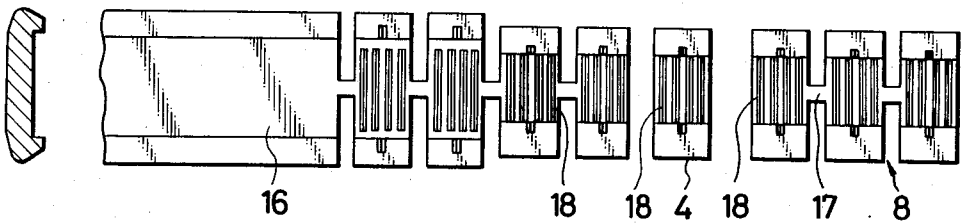
FIG. 7A is a fragmentary plan view of a second blank strip, illustrating the manner in which first and second clamping strips are manufactured from the second blank strip.
FIG. 7B is a transverse cross-sectional view of FIG. 7A.
FIG. 7C is a plan view of the individual first clamping strip.
FIG. 7D is a plan view of the individual second clamping strip.

Likewise, the individual first clamping strip 4 and the individual second clamping strip 8 are manufactured from a continuous length of second blank strip 16 by punching and cutting the second blank strip 16. Preferably, the length of each second clamping strip 8 is several times the width of a single first clamping strip 4. In the embodiment of FIGS. 1 and 7D, each second clamping strip 8 is in the form of three first clamping strips 4 spaced laterally at regular distances and integrally connected to one another by connecting portions 17.

As shown in FIGS. 7A and 7D, each of the first and second clamping strips 4, 8 has in its inside surface a plurality of laterally spaced grooves 18 which serve to prevent the clamping strips 4, 8 from being displaced longitudinally along the folded edge portion 3 of the tape 5. Alternatively, these grooves 18 may be replaced with ridges for the same result.

Figure 8:
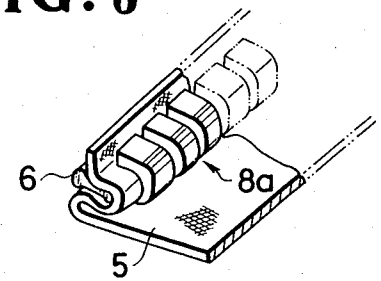
FIGS. 8 and 9 are fragmentary perspective views respectively showing modified second clamping strips.
Figure 9:
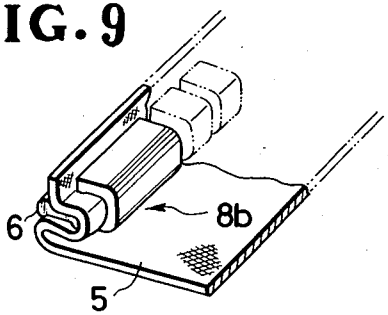
Figure 10A:
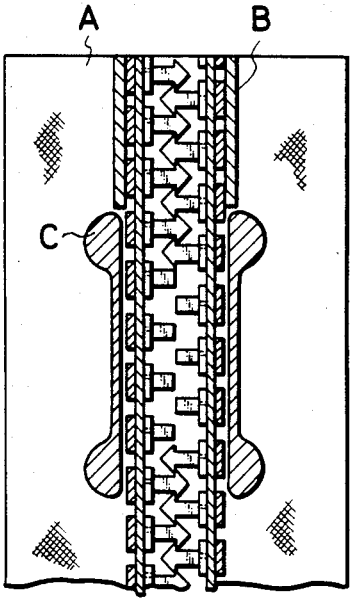
FIG. 10A (PRIOR ART)
FIG. 10A is a fragmentary plan view, with parts in cross section, of a prior art fluid-tight slide fastener.
Figure 10B:
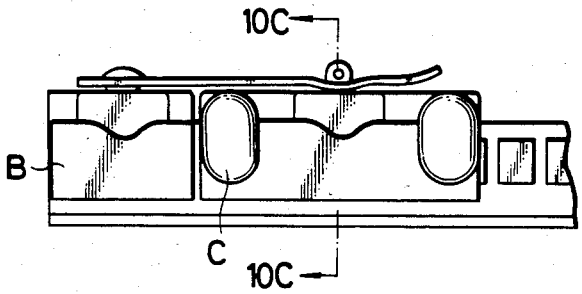
FIG. 10B (PRIOR ART)
FIG. 10B is a side elevational view of FIG. 10A.
Figure 10C:
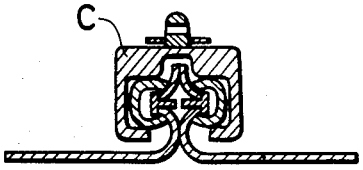
FIG. 10C (PRIOR ART)
FIG. 10C is a transverse cross-sectional view taken along line 10C—10C of FIG. 10B.

FIGS. 8 and 9 show modified second clamping strips 8*a*, 8*b*, respectively. The second clamping strip 8*a* of FIG. 8 is composed of three separate pieces each in the shape of a single first clamping strip 4 of FIGS. 1, 2 and 7C. The second clamping strip 8*b* of FIG. 9 is a single piece having a uniform cross section through its entire length.

The first and second blank strips 15, 16 of FIGS. 6A, 6B, 7A and 7B are made of metal. Alternatively, the first blank strip 15 may be made of hard synthetic resin. In another alternative form, the elongate plates 6 are individually formed by injection-molding synthetic resin material.

According to the fluid-tight slide fastener of the invention, because each top stop comprises an elongate plate having a cross section substantially corresponding to the shape of the individual coupling element and a second clamping strip having a cross section substantially corresponding to the shape of the individual first clamping strip, the opposed top stops can enter the guide channel of the slider smoothly when the slider is pulled upwardly or forwardly to close the slide fastener. At that time the upward movement of the slider is not prevented until the opposed top stops are entirely inserted into the guide channel of the slider to abut against each other, without any part thereof exposed to the outside, thus making the slide fastener neat in appearance.

Further, partly because the base part of each elongate plate is surrounded by the folded edge portion of the respective tape, and partly because each second clamping strip surrounds, in clinched form, this folded edge portion over the base part of the elongate plate, firm attachment of the top stops to the fastener stringers can be achieved.

In addition, since the opposed elongate plates block each other accurately at the junction of the two branches of the guide channel in the slider as the slide fastener is fully closed, it is possible to stop the upward movement of the slider reliably.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A fluid-tight slide fastener comprising:

(a) a pair of fastener stringers each including (1) a fluid-tight tape, (2) a series of discrete coupling elements mounted on said tape along an inner longitudinal edge portion thereof, each of said coupling element having a base portion, a leg portion and a head portion, (3) said inner longitudinal edge portion of said tape being folded so as to extend around said base portion of each said coupling element, (4) a series of generally U-shaped first clamping strips each surrounding said folded edge portion of said tape over said base portion of a respective one of said coupling elements, and (5) a pair of top stops each mounted on the respective tape at a position adjacent to a top end of said series of coupling elements;

(b) a slider mounted on said pair of fastener stringers for movement along such two series of coupling elements to open and close the slide fastener, said slider having a generally Y-shaped guide channel for the passage of said two series of coupling elements; and (c) each said top stop including (1) an elongate plate of a generally I-shaped cross section substantially corresponding to the shape of the individual coupling element, said elongate plate having such a length as to be completely received in said guide channel of said slider when the slide fastener is fully closed, said folded edge portion extending around a base part of said elongate plate which part corresponds to said base portion of the individual coupling element, and (2) an elongate second clamping strip of a generally U-shaped cross section substantially corresponding to the shape of the individual first clamping strip, said second clamping strip surrounding said folded edge portion of said tape over said base part of said elongate plate.

2. A fluid-tight slide fastener according to claim 1, said length of said elongate plate being several times the width of the individual coupling element.

3. A fluid-tight slide fastener according to claim 1, said length of said second clamping strip being several times the width of the individual first clamping strip.

4. A fluid-tight slide fastener according to claim 1, said second clamping strip being in the form of several first clamping strips spaced laterally at regular distances and integrally connected to one another by connecting portions.

5. A fluid-tight slide fastener according to claim 1, each of said first and second clamping strips having in its inside surface a plurality of laterally spaced grooves.

* * * * *